US007212166B2

(12) United States Patent
Tseng et al.

(10) Patent No.: US 7,212,166 B2
(45) Date of Patent: May 1, 2007

(54) ANTENNA STRUCTURE

(75) Inventors: Hung-Wei Tseng, Tainan (TW); Yueh-Lin Tsai, Shulin Town, Yunlin County (TW)

(73) Assignee: Inpaq Technology Co., Ltd., Hsinchu (TW)

( * ) Notice: Subject to any disclaimer, the term of this patent is extended or adjusted under 35 U.S.C. 154(b) by 0 days.

(21) Appl. No.: 11/063,775

(22) Filed: Feb. 24, 2005

(65) Prior Publication Data

US 2006/0017618 A1 Jan. 26, 2006

(30) Foreign Application Priority Data

Jul. 9, 2004 (TW) ..... 93210915 U

(51) Int. Cl.
*H01Q 1/24* (2006.01)

(52) U.S. Cl. ..... 343/702

(58) Field of Classification Search ..... 343/702, 343/700 MS, 824, 853
See application file for complete search history.

(56) References Cited

U.S. PATENT DOCUMENTS 5,510,803 A * 4/1996 Ishizaka et al. ..... 343/700 MS
5,872,545 A * 2/1999 Rammos ..... 343/770
6,031,491 A * 2/2000 Daniel et al. ..... 343/700 MS
6,356,245 B2 * 3/2002 Metzen et al. ..... 343/905
6,489,924 B2 * 12/2002 Pretorius et al. ..... 343/700 MS
6,768,471 B2 * 7/2004 Bostwick et al. ..... 343/853
6,947,008 B2 * 9/2005 Tillery et al. ..... 343/824

* cited by examiner

*Primary Examiner*—Hoanganh Le
*Assistant Examiner*—Huedung Mancuso
(74) *Attorney, Agent, or Firm*—Rosenberg, Klein & Lee

(57) ABSTRACT

An antenna module has a PCB with a plurality of contacts, a support element, and an antenna module. The support element has a support portion extended downwardly therefrom. The antenna module is connected with the support element. The antenna structure has a metal support element fixed on the PCB with a plurality of contacts. The support element is used to support an antenna module for electrically connecting the antenna module on the PCB with the contacts. When the antenna module connects to the PCB, the antenna contact does not project out the bottom side of the PCB. Therefore, the bottom side of the PCB is level. The antenna structure has a metal support used to shield the noise interference between the antenna module and the PCB.

13 Claims, 8 Drawing Sheets

ANTENNA STRUCTURE

BACKGROUND OF THE INVENTION

1. Field of the Invention

The present invention relates to an antenna structure, and particularly relates to an antenna structure that has an antenna module supported by a metal support element and in which the antenna module contacts the PCB with a plurality of contacts.

2. Description of the Related Art

FIG. 1 shows a cross-sectional view of the antenna structure according to the prior art. The antenna structure includes a PCB 1*a*, and an antenna module 2*a* connected to the PCB 1*a*. The antenna module 2*a* has an antenna contact 20*a* inserted into and electrically connected to the PCB 1*a*. The antenna contact 20*a* has a bottom side 200*a* projected out the PCB 1*a*. A heatproof twin adhesive 3*a* attaches the antenna module 2*a* on the PCB 1*a*.

However, the prior art has some defects, as follows:

(1) The heatproof twin adhesive 3*a* attaches the antenna module 2*a* to the PCB 1*a*, so the antenna structure is not conveniently assembled;

(2) The heatproof twin adhesive 3*a* attaches the antenna module 2*a* to the PCB 1*a*, so it is not convenient to use the twin adhesive 3*a*. Therefore, the quality of the antenna structure is not stable, and the price of the antenna structure is not good;

(3) The bottom side 200*a* of the antenna contact 20*a* is projected out the PCB 1*a*, so the bottom side of the PCB 1*a* is not level; and (4) Noise interference occurs between the antenna module 2*a* and the PCB 1*a*.

SUMMARY OF THE INVENTION

The first objective of the present invention is to provide an antenna structure. The antenna structure has a metal support element fixed on the PCB with a plurality of contacts. The support element is used to support an antenna module for electrically connecting the antenna module on the PCB with the contacts.

The second objective of the present invention is to provide an antenna structure. When the antenna module connects to the PCB, the antenna contact does not project out the bottom side of the PCB. Therefore, the bottom side of the PCB is level.

The third objective of the present invention is to provide an antenna structure. The antenna structure has a metal support used to shield the noise interference between the antenna module and the PCB.

In order to achieve the above objects, the present invention provides an antenna module comprising a PCB with a plurality of contacts, a support element, and an antenna module.

The support element has a support portion extended downwardly therefrom, and the support element is fixed on the PCB by the support portion. The antenna module is connected with the support element, and has an antenna contact inserted into the PCB. It is to be understood that both the foregoing general description and the following detailed description are exemplary, and are intended to provide further explanation of the invention as claimed. Other advantages and features of the invention will be apparent from the following description, drawings and claims.

BRIEF DESCRIPTION OF THE DRAWINGS

The various objects and advantages of the present invention will be more readily understood from the following detailed description when read in conjunction with the appended drawing, in which.

DETAILED DESCRIPTION OF PREFERRED EMBODIMENTS

Figure 1:
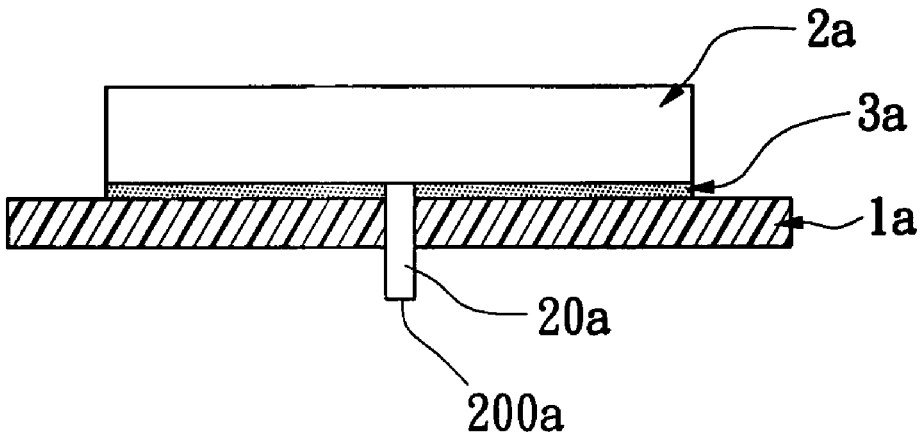
FIG. 1 PRIOR ART
FIG. 1 is a cross-sectional view of the antenna structure of the prior art.
Figure 2:
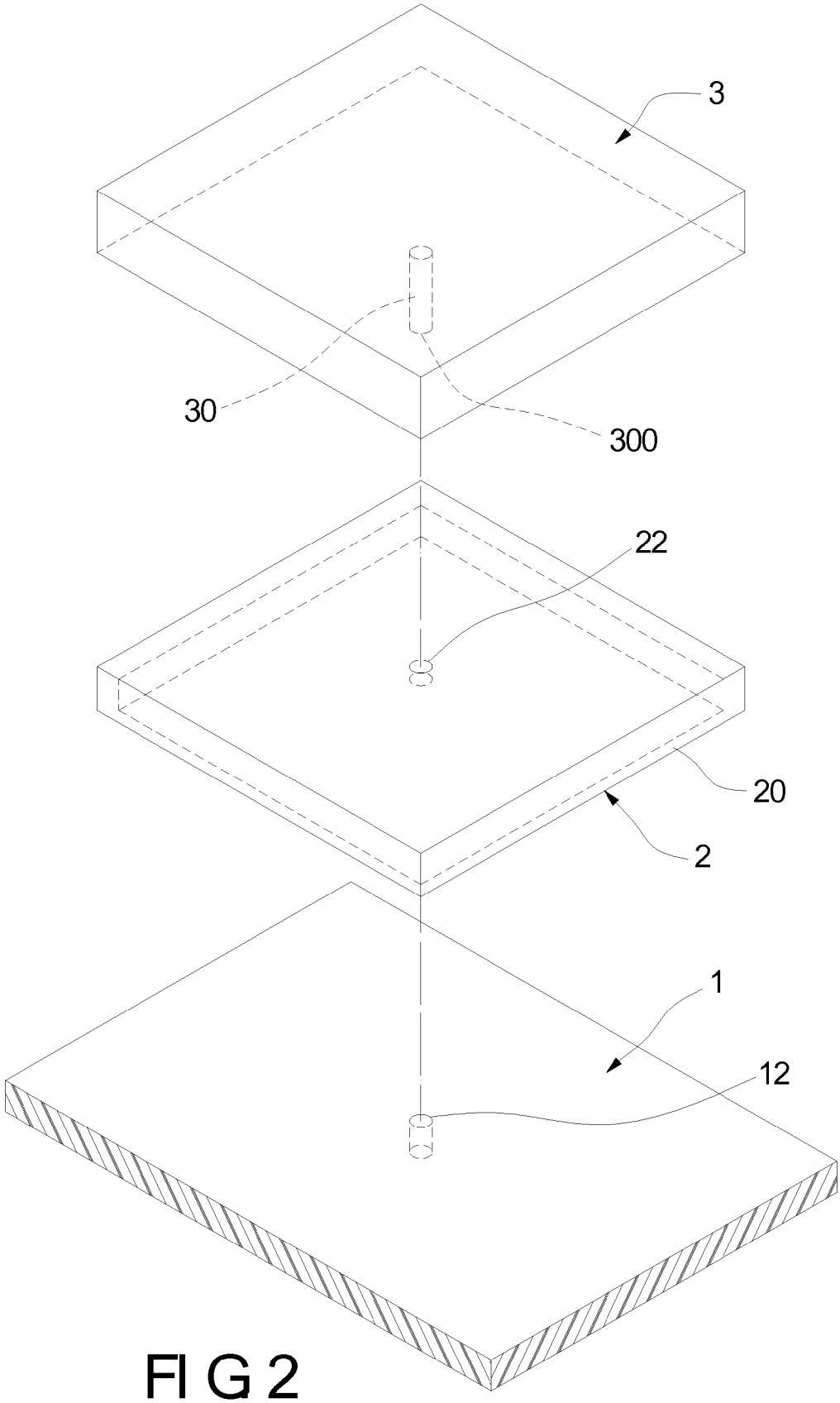
FIG. 2 is a perspective, exploded view of the antenna structure according to the first embodiment of the present invention.
Figure 3:
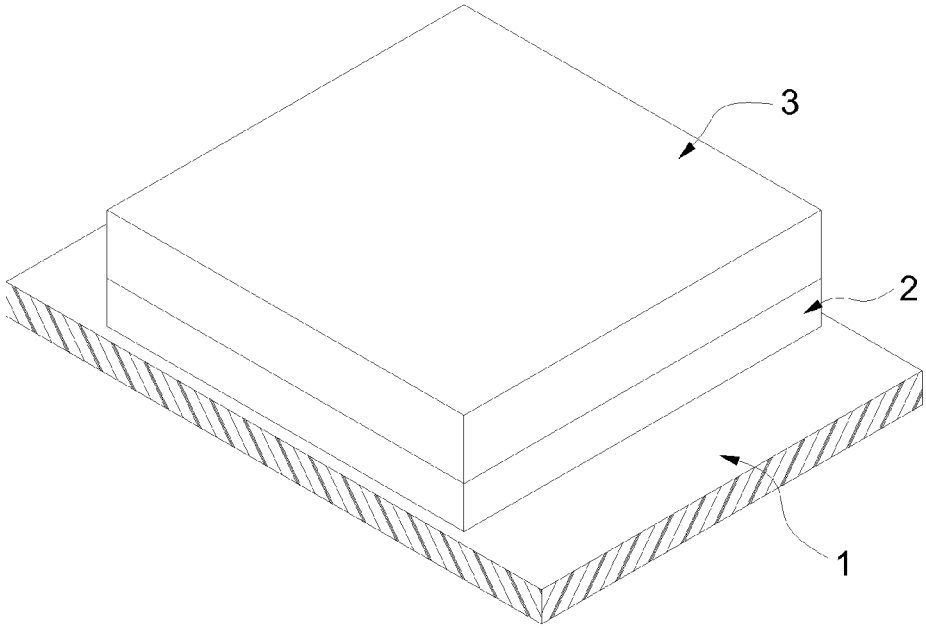
FIG. 3 is a perspective, assembled view of the antenna structure according to the first embodiment of the present invention.

Referring to FIGS. 2 and 3, the first embodiment of the present invention provides an antenna structure including a PCB 1 with a plurality of contacts, a metal support element 2, and an antenna module 3.

The metal support element 2 is metal covered support, and has a support portion 20 formed therearound. The support portion 20 is fixed on the PCB 1 by SMT (Surface Mounted Technology) or inserted solder technology. The antenna module 3 is a GPS (Global Positioning System). The antenna module 3 is connected on the metal support element 2 by an adhesive body (not shown). The antenna module 3 has an antenna contact 30 that passes through a through hole 22 of the metal support element 2 and is inserted into a corresponding through hole 12 of the PCB 1. The adhesive body is a ceramics adhesive or a heatproof adhesive.

Figure 5:
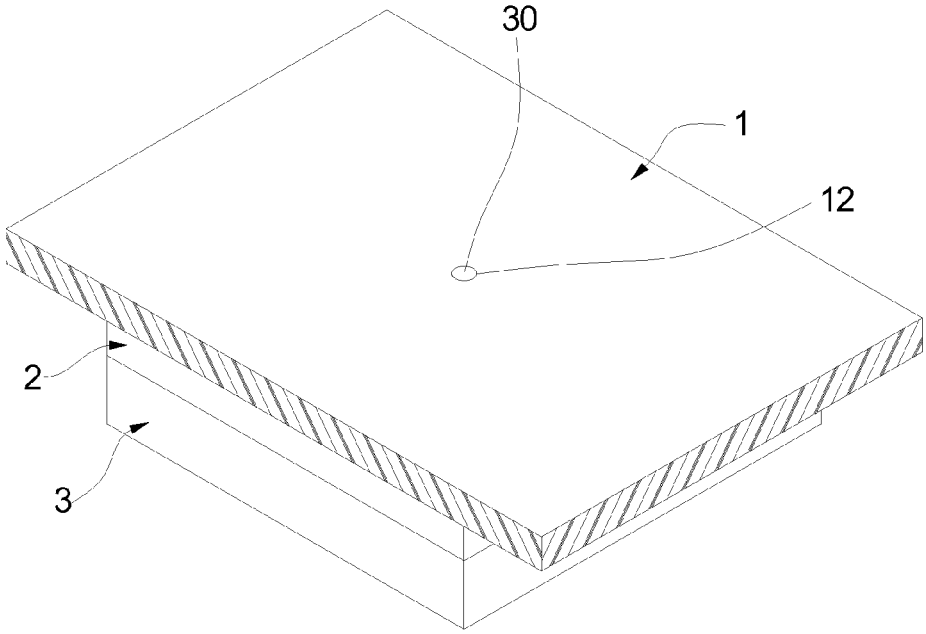
FIG. 5 is another perspective, assembled view of the antenna structure according to the first embodiment of the present invention.
Figure 4:
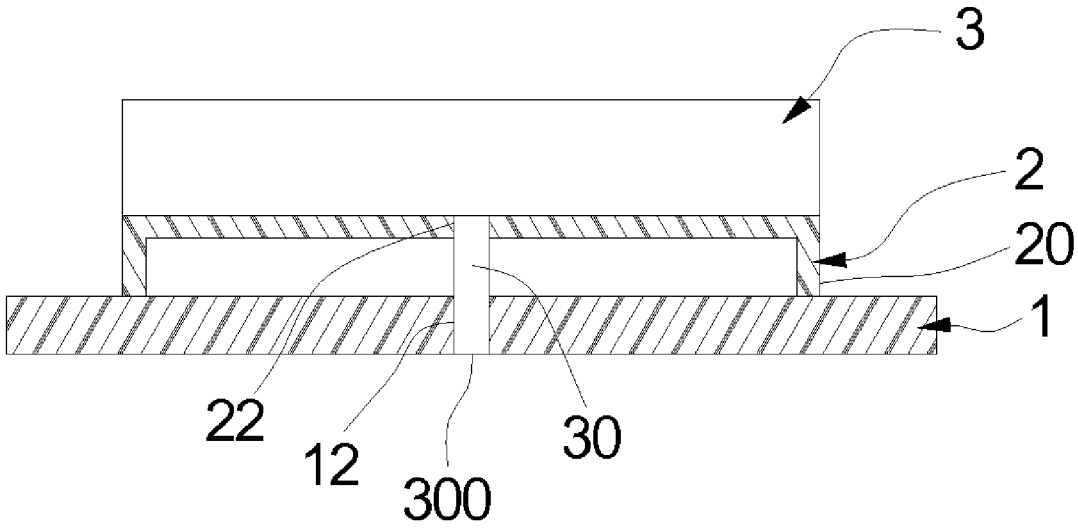
FIG. 4 a cross-sectional view of the antenna structure according to the first embodiment of the present invention.

Referring to the FIGS. 4 and 5, the antenna contact 30 of the antenna module 3 has a bottom side 300. The metal support element 2 is used to support the antenna module 3 for the bottom side 300 of the contact 30 to be embedded in the through hole 12 of the PCB 1. In other words, the antenna contact 30 of the antenna module 3 is electrically connected to the PCB 1, and does not project out of the through hole 12 on a bottom side of the PCB 1. Therefore, the bottom side of the PCB 1 is level.

The metal support element 2 is used to shield the noise interference between the PCB 1 and the antenna module 3 for increasing the security of the antenna module 3 in use.

Figure 6:
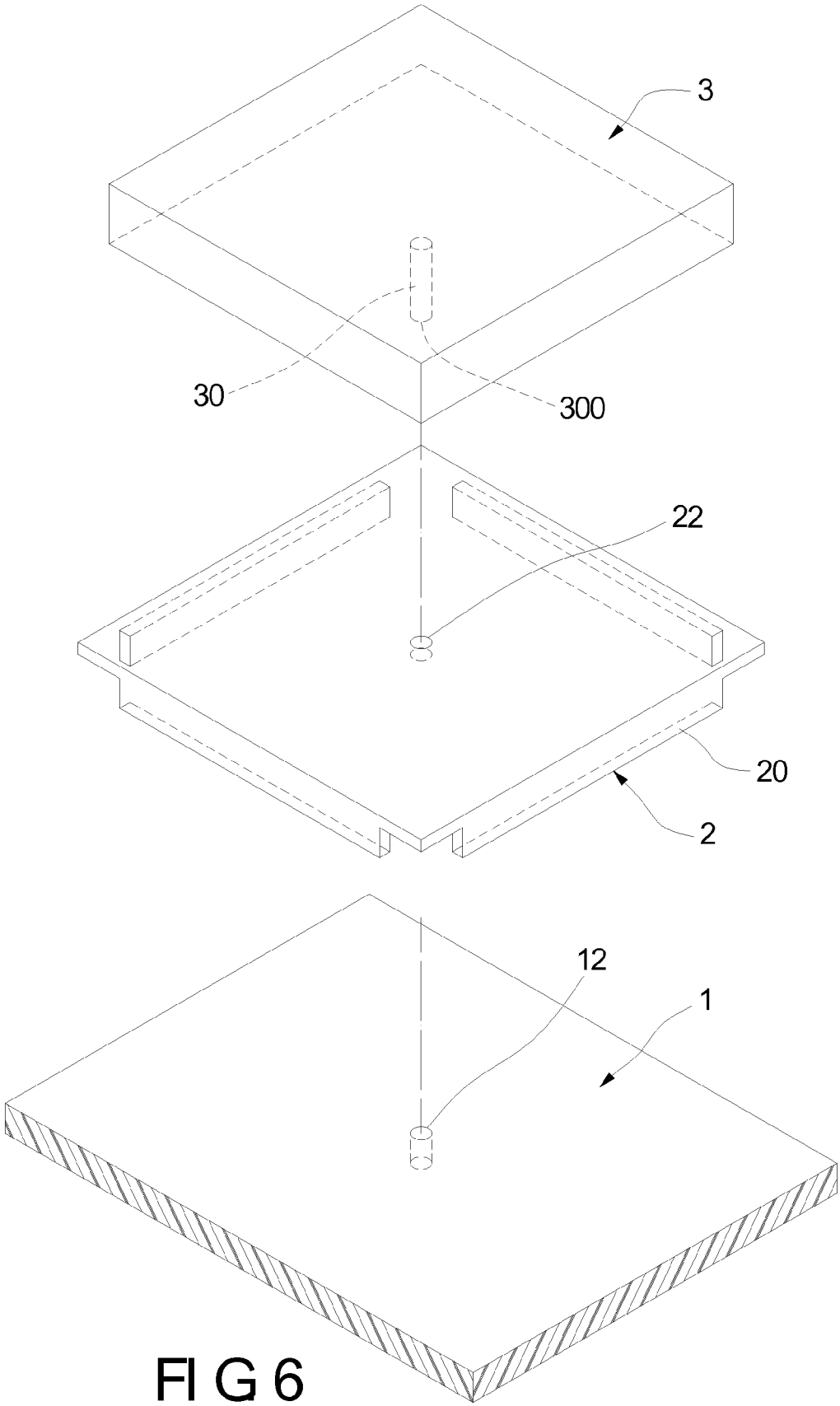
FIG. 6 is a perspective, exploded view of the antenna structure according to the second embodiment of the present invention.
Figure 7:
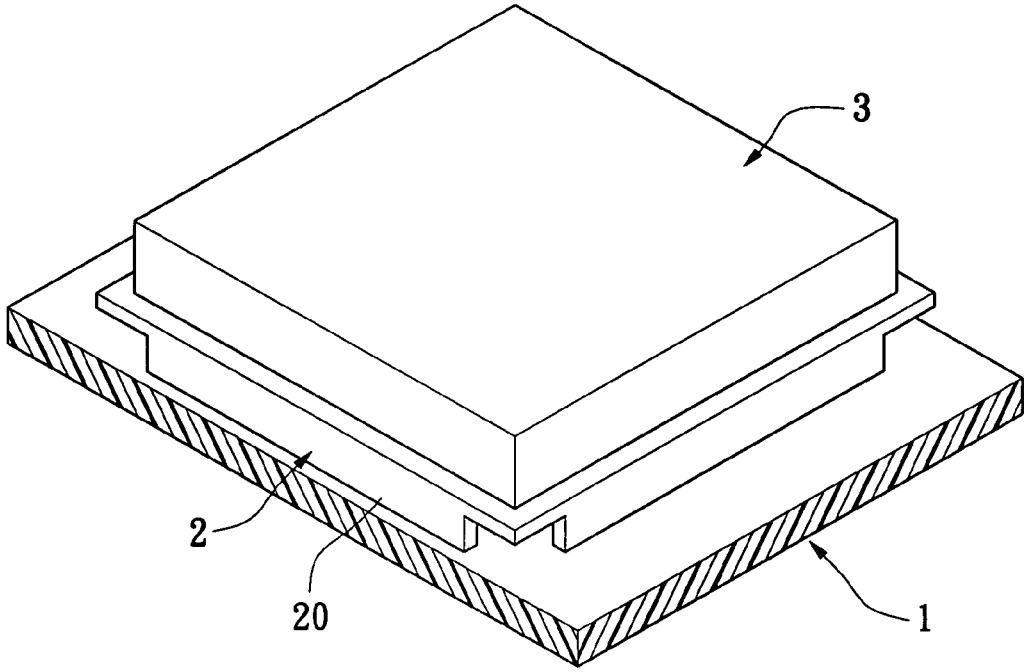
FIG. 7 is a perspective, assembled view of the antenna structure according to the second embodiment of the present invention.

The FIGS. 6 and 7 show the second embodiment of the present invention. The support portion 20 of the metal support element 2 is a plurality of pins extended downwardly therefrom. The present invention does not limit the number of the pins and the distance between the two pins.

The metal support element 2 has a contact surface smaller or larger than that of the antenna module 3. The metal support element 2 has different shapes according to the designer for the antenna module 3.

Figure 8:
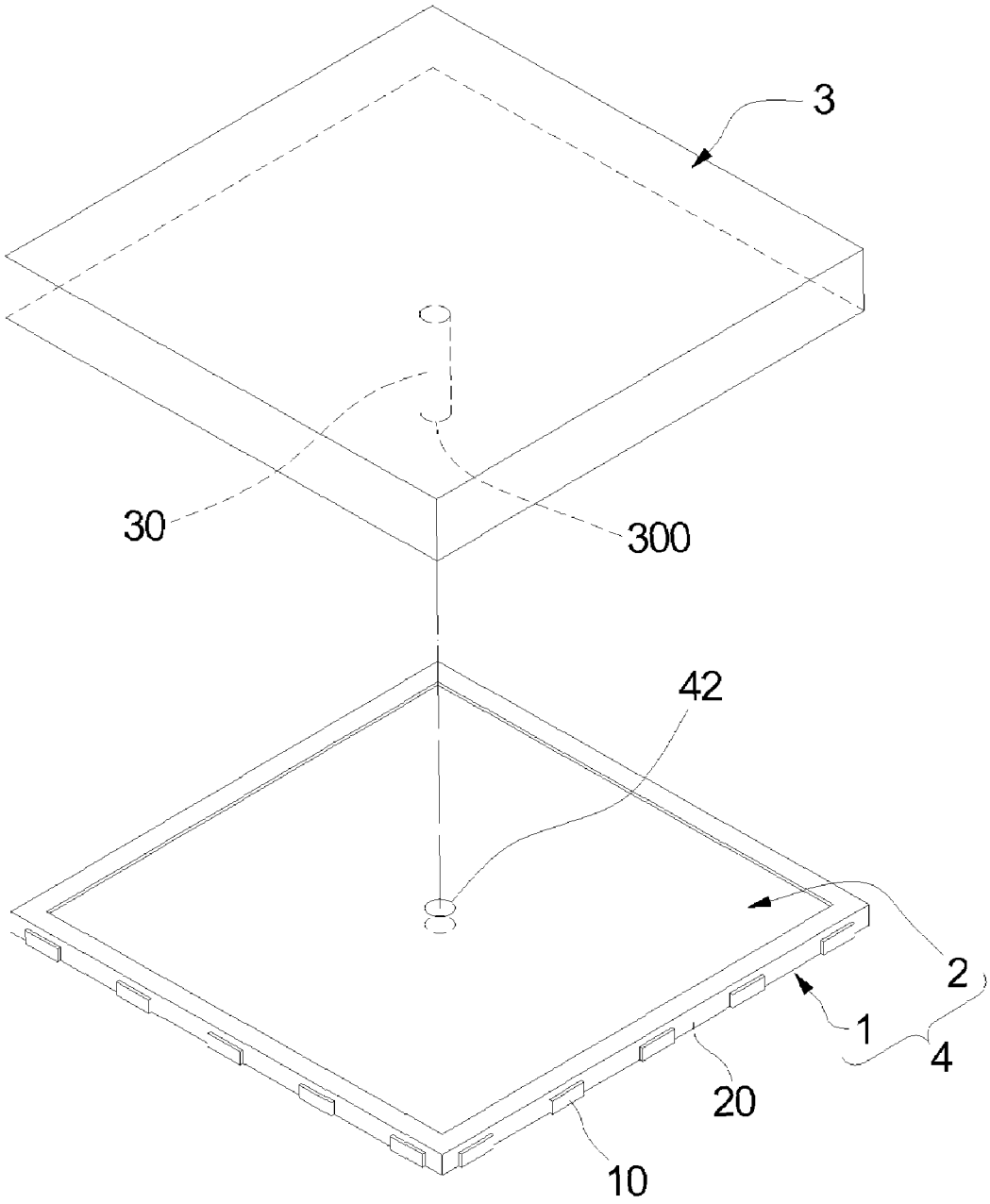
FIG. 8 is a perspective, exploded view of the antenna structure according to the third embodiment of the present invention.
Figure 9:
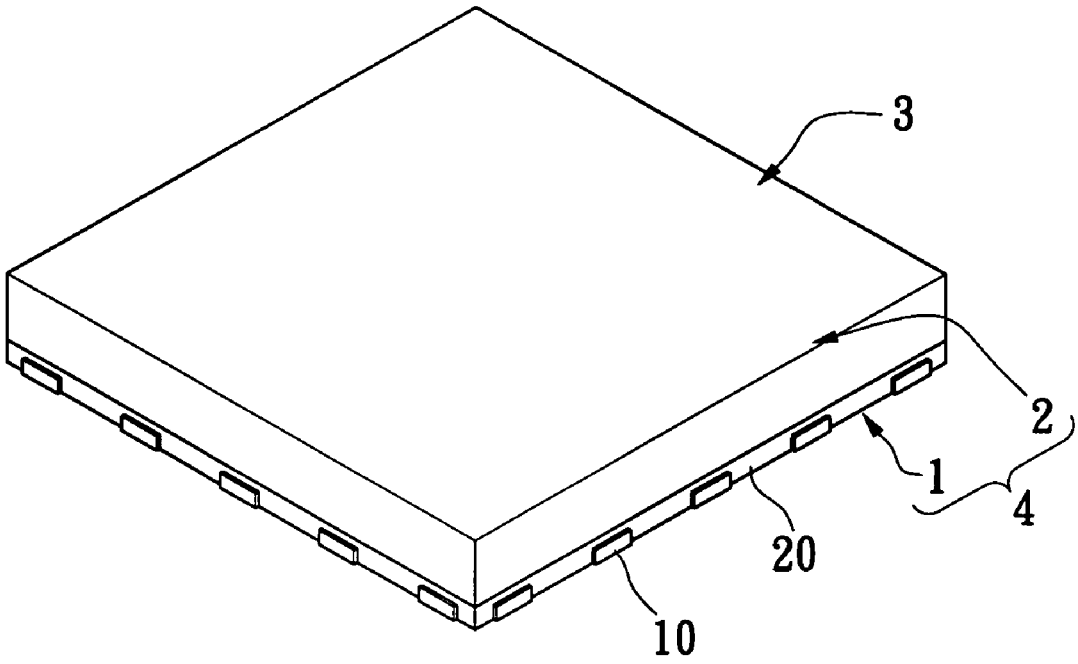
FIG. 9 is a perspective, assembled view of the antenna structure according to the third embodiment of the present invention.

The FIGS. 8 and 9 show the third embodiment of the present invention. The PCB 1 has a plurality of pins 10 disposed on a bottom portion thereof.

The PCB 1 and the support element 2 are joined together to form a circuit module 4 by low-temperature cofired technology. The circuit module 4 and the antenna module 3 are assembled together to form an antenna module with a circuit function. The PCB 1 is fixed on the support portion 20 of the support element 2 by the pins 10. Moreover, the antenna structure is filled with good heat-conducting material between the PCB 1 and the support element 2.

To sum up, the antenna structure of the present invention includes some advantages, as follow:

(1) The support portion 20 of the support element 2 is fixed on the PCB 1 by SMT or inserted solder technology for increasing the convenience to assemble the antenna structure;

(2) When the antenna module 3 connects to the PCB 1, the antenna contact 30 of the antenna module 3 passes into the through opening 42 and does not project out the bottom side of the PCB 1. Hence, the bottom side of the PCB 1 is level; and (3) The support element 2 is arranged between the PCB 1 and the antenna module 3 for shielding the noise interference between the antenna module 3 and the PCB 1, and increasing the sensitivity of the antenna module 3 in use.

Although the present invention has been described with reference to the preferred embodiment thereof, it will be understood that the invention is not limited to the details thereof. Various substitutions and modification have suggested in the foregoing description, and other will occur to those of ordinary skill in the art. Therefore, all such substitutions and modifications are intended to be embraced within the scope of the invention as defined in the appended claims.

What is claimed is:

1. An antenna module, comprising:

a PCB having a plurality of contacts formed thereat and further having an aperture formed therethrough;

an antenna module, said antenna module including an antenna contact extending therefrom and having a contact bottom side;

a conductive support element sandwiched between said antenna module and said PCB to shield noise interference therebetween, said support element including a support portion extended downwardly therefrom, said support element being fixed on the PCB by the support portion; and having an aperture formed therethrough in alignment with said aperture of said PCB, said antenna contact extending through said aperture of said support element and said aperture of said PCB with said contact bottom side of said antenna contact embedded in said PCB, thereby electrically connecting said antenna module with said plurality of contacts formed at the PCB.

2. The antenna module as claimed in claim 1, wherein the support element is a metal support.

3. The antenna module as claimed in claim 1, wherein the support element has a contact surface larger than that of the antenna module.

4. The antenna module as claimed in claim 1, wherein the support element has a contact surface smaller than that of the antenna module.

5. The antenna module as claimed in claim 1, wherein the support portion has a plurality of pins.

6. The antenna module as claimed in claim 1, wherein the support portion is fixed on the PCB by SMT (Surface Mounted Technology).

7. The antenna module as claimed in claim 1, wherein the support portion is fixed on the PCB by an inserted solder technology.

8. The antenna module as claimed in claim 1, wherein the antenna module is a GPS (Global Positioning System).

9. The antenna module as claimed in claim 1, wherein the antenna module is connected to the support element by an adhesive body.

10. The antenna module as claimed in claim 9, wherein the adhesive body is a ceramics adhesive or a heatproof adhesive.

11. The antenna module as claimed in claim 1, wherein said contact bottom side of said antenna contact of the antenna module is leveled with a bottom surface of said PCB.

12. The antenna module as claimed in claim 1, wherein the PCB has a plurality of pins disposed on a bottom portion thereof.

13. The antenna module as claimed in claim 1, wherein the PCB and the support element are jointed together to form a circuit module by low-temperature cofired technology, and wherein the circuit module and the antenna module are assembled together to form the antenna module with a circuit function.

* * * * *